US008708448B2

(12) United States Patent
Nakamura et al.

(10) Patent No.: US 8,708,448 B2
(45) Date of Patent: Apr. 29, 2014

(54) IMAGE RECORDING APPARATUS

(75) Inventors: Hirotake Nakamura, Nagoya (JP); Hiroaki Yazawa, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 441 days.

(21) Appl. No.: 13/049,388

(22) Filed: Mar. 16, 2011

(65) Prior Publication Data

US 2011/0228312 A1 Sep. 22, 2011

(30) Foreign Application Priority Data

Mar. 17, 2010 (JP) ..... 2010-060163

(51) Int. Cl.
*B41J 29/38* (2006.01)

(52) U.S. Cl.
USPC ..... 347/19; 347/5; 347/9; 358/1.14; 358/1.15

(58) Field of Classification Search
CPC ..... B41J 2/01; B41J 29/38
See application file for complete search history.

(56) References Cited

U.S. PATENT DOCUMENTS

| | | | | |
|---|---|---|---|---|
| 7,213,897 | B2 * | 5/2007 | Kosugi | 347/5 |
| 7,422,302 | B2 * | 9/2008 | Tanaka | 347/19 |
| 7,792,456 | B2 | 9/2010 | Okamoto et al. | |
| 2002/0196302 | A1 * | 12/2002 | Saruta | 347/19 |
| 2005/0128239 | A1 | 6/2005 | Tanaka | |
| 2006/0227161 | A1 * | 10/2006 | Otsuki | 347/19 |
| 2009/0136242 | A1 | 5/2009 | Okamoto et al. | |
| 2009/0153602 | A1 * | 6/2009 | Brown et al. | 347/7 |
| 2011/0205263 | A1 * | 8/2011 | Donahue et al. | 347/6 |

FOREIGN PATENT DOCUMENTS

| | | | |
|---|---|---|---|
| JP | 9058018 | 3/1997 | |
| JP | 2004-326125 | 11/2004 | |
| JP | 2005/104117 | 4/2005 | |
| JP | 2005104117 | * 4/2005 | B41J 2/174 |
| JP | 2006/080864 | 3/2006 | |
| JP | 2007/001065 | 1/2007 | |
| JP | 2007/001066 | 1/2007 | |
| JP | 2009-128783 | 6/2009 | |
| JP | 2009-139451 | 6/2009 | |
| JP | 2009-282153 | 12/2009 | |

(Continued)

OTHER PUBLICATIONS

Decision to Grant a Patent of Japanese Patent Application No. 2010-060163 dated Dec. 4, 2012.

(Continued)

*Primary Examiner* — Manish S Shah
*Assistant Examiner* — Jeremy Delozier
(74) *Attorney, Agent, or Firm* — Frommer Lawrence & Haug LLP

(57) ABSTRACT

An image recording apparatus, including: an apparatus body; a cartridge containing a recording material; a cartridge installing section which is provided in the apparatus body and to which the cartridge is removably installed; a first communication section which is provided in the apparatus body; a second communication section which is provided in the cartridge and which communicates with the first communication section by using a near field communication; a light source which is provided in the apparatus body and emits light to illuminate the cartridge installing section; an installation/removal detector which is provided in the apparatus body and detects whether or not the cartridge is installed to the cartridge installing section; and a controller which controls the light source and the first communication section.

8 Claims, 7 Drawing Sheets

(56) References Cited

FOREIGN PATENT DOCUMENTS

| | | | | |
|---|---|---|---|---|
| JP | 2010-012659 | | 12/2009 | |
| JP | 2010012659 | * | 1/2010 | ..... B41J 2/175 |
| WO | WO03082582 | | 10/2003 | |

OTHER PUBLICATIONS

Notice of Reasons for Rejections of Japanese Patent Application No. 2010-060163 dated Jul. 10, 2012.
Machine translation for JP 9-058018.

* cited by examiner

IMAGE RECORDING APPARATUS

CROSS REFERENCE TO RELATED APPLICATION

The present application claims priority from Japanese Patent Application No. 2010-060163, filed on Mar. 17, 2010, the disclosure of which is incorporated herein by reference in its entirety.

BACKGROUND OF THE INVENTION

1. Field of the Invention

The present invention relates to an image recording apparatus in which a cartridge installing section is provided to an apparatus body. A cartridge containing a recording material is removably installed to the cartridge installing section.

2. Description of the Related Art

As a multifunction machine in which a printer function, a seamier function, etc. are integrated, the multifunction machine in which an upper unit having the scanner function is rotatably attached to a lower unit having the printer function by a hinged structure has hitherto been known (For example, refer to Japanese Patent Application Laid-open No. 2006-80864). The multifunction machine is configured such that the upper unit is rotated upward to open an opening of an upper surface of the lower unit for a user to replace the cartridge containing the recording material such as an ink or the like.

However, the upper unit becomes heavy due to a scanner body, a document pressing cover, an ADF, etc. Accordingly, in order to prevent too much opening of the upper unit with respect the lower unit, a stopper limiting an opening angle of the upper unit with respect to the lower unit is usually provided. In this case, cartridge replacement is performed in a state that the upper unit is slightly rotated upward, and thus, an area near the opening of the upper surface of the lower unit is dark and it is difficult for the user to replace the cartridge. Further, the darkness of the area near the cartridge installing section may cause a possibility that the cartridge is installed to an incorrect position.

An object of the present invention is to improve workability when the cartridge is replaced by the user.

SUMMARY OF THE INVENTION

The present invention has been made taking the foregoing circumstances into consideration, according to an aspect of the present invention, there is provided an image recording apparatus, including: an apparatus body; a cartridge containing a recording material; a cartridge installing section which is provided in the apparatus body and to which the cartridge is removably installed; a first communication section which is provided in the apparatus body; a second communication section which is provided in the cartridge and which communicates with the first communication section by using a near field communication; a light source which is provided in the apparatus body and emits light to illuminate the cartridge installing section; an installation/removal detector which is provided in the apparatus body and detects whether or not the cartridge is installed to the cartridge installing section; and a controller which controls the light source and the first communication section; and the controller controls the light source to emit the light in a case that the first communication section receives a predetermined information from the second communication section, and the controller turns the first communication section on in a case that the installation/removal detector detects a removal of the cartridge from the cartridge installing section and turns the first communication section off in a case that the installation/removal detector detects an installation of the cartridge to the cartridge installing section.

According to this configuration, in a case that the cartridge is removed from the cartridge installing section and is within a predetermined range from the first communication section of the apparatus body, and that the first communication section receives the predetermined information from the second communication section by the near field communication, the light source emits the light to illuminate the cartridge installing section, and thus, workability of cartridge replacement is improved. Further, in a case that the cartridge is installed to the cartridge installing section, the first communication section is turned off. Accordingly, while the cartridge is installed to the cartridge installing section, it is possible to prevent malfunction of the light source and to reduce power consumption required for the first communication section. Furthermore, in a case that the cartridge is removed and away from the cartridge installing section by a distance to some extent to move to the outside of the communication area, the first communication section is not capable of receiving the information from the second communication section. Thus, even when the cartridge is removed from the cartridge installing section, the light source does not emit the light, and electricity required for the light source can also be reduced.

DESCRIPTION OF THE PREFERRED EMBODIMENTS

Embodiments of the present invention will be explained below with reference to the drawings.

Figure 1:
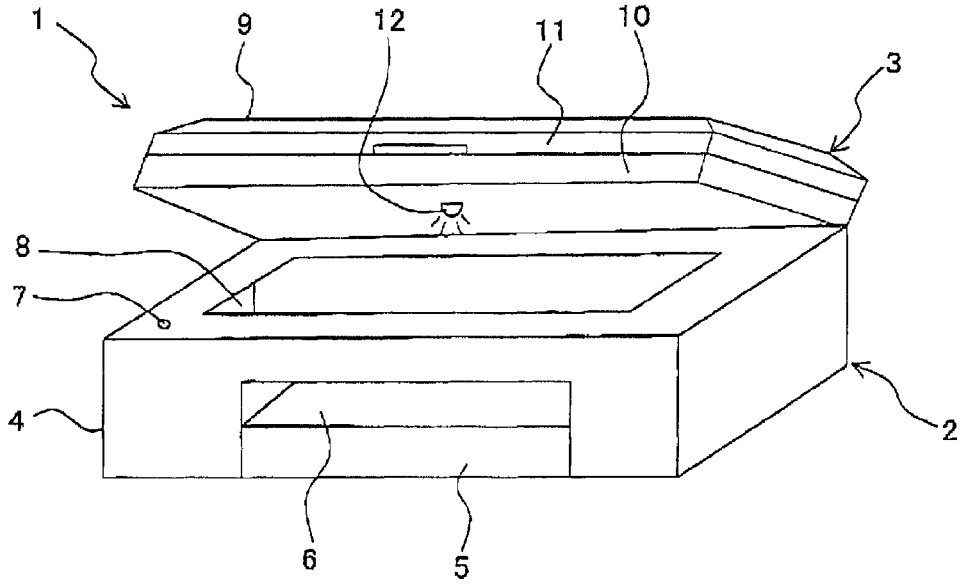
FIG. 1 is a perspective view of a multifunction machine including an ink-jet printer according to a first embodiment of the present invention.

As shown in FIG. 1, a multifunction machine 1 includes a lower unit 2, an upper unit 3 connected by a hinged structure (hinge) at rear end portions so that the upper unit 3 is rotatable upward with respect to the lower unit 2. The multifunction machine 1 has a printer function, a scanner function, a copy function, and a facsimile function. The lower unit 2 is mainly provided with an ink-jet printer 4 (image forming apparatus). The upper unit 3 is mainly provided with a flat-bed scanner 9. A paper feeding tray 5 is provided at a lower stage of a front surface of the lower unit 2, and a paper discharge tray 6 is provided at an upper stage thereof. An opening 8 for maintenance is formed in an upper surface of the lower unit 2 and a warning device 7 which is a LED warning lamp is provided to the upper surface of the lower unit 2.

The upper unit 3 includes a scanner body 10 and a cover 11 thereof. An input device and a display screen (not shown) for operating the ink-jet printer 4, the scanner 9, etc. are provided at an upper-portion front-surface side of the cover 11. A maximum opening angle of the upper unit 3 with respect to the lower unit 2 is an acute angle (less than 90°). Even when the upper unit 3 is fully opened with respect to the lower unit 2, at least a portion of the upper unit 3 is positioned above the opening 8. This is because the upper unit 3 is heavy owing to the provision of the scanner 9, and thus there is a need to prevent the entire apparatus from falling backward at the time of rotating of the upper unit 3. A light source 12 constructed of a LED lamp is provided on a bottom surface of the upper unit 3 so that the light source 12 is facing the opening 8 of the lower unit 2. That is, in a case that the upper unit 3 is opened upward with respect to the lower unit 2, a light emitted from the light source 12 illuminates the opening 8. On the other hand, in a case that the upper unit 3 is closed so that the upper unit 3 is placed on the upper surface of the lower unit 2, the light source 12 is accommodated in the multifunction machine 1 so that the light source 12 is not seen from outside.

Figure 2:
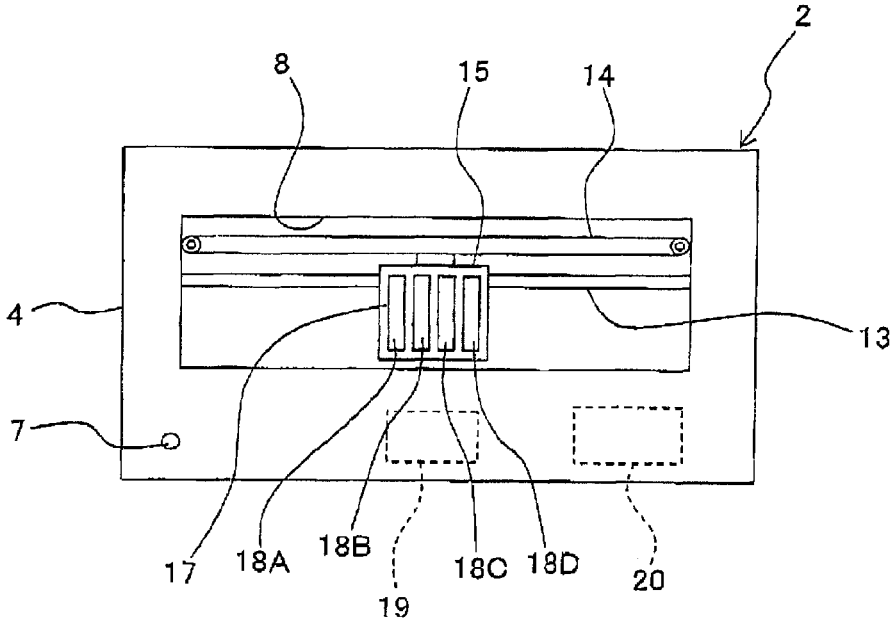
FIG. 2 is a plan view of a lower unit of the multifunction machine according to the first embodiment of the present invention.

As shown in FIG. 2, in the ink-jet printer 4 of the lower unit 2, a guide shaft 13 is installed to extend in a left-right direction. A carriage 15 is slidably supported in the left-right direction (scanning direction) by the guide shaft 13. The carriage 15 is joined to a timing belt 14 which reciprocates in the left-right direction. A motor (not shown) reciprocates the timing belt 14, thereby reciprocating the carriage 15 in the left-right direction.

A cartridge installing section 17 is provided on an upper surface side of the carriage 15. Four cartridges, a first to a fourth cartridges 18A to 18D, containing four color (black, cyan, magenta, and yellow) inks (recording materials) respectively, are removably installed to the cartridge installing section 17. An ink-jet head (not shown) in which nozzles jetting inks are formed is installed on a lower surface side of the carriage 15. That is, at a lower portion of the carriage 15, the inks are jetted from nozzles of the ink-jet head (not shown) onto a paper transported in a front-back direction which is orthogonal to the scanning direction, thereby recording an image onto the paper.

A recognition device 19 (a first communication section) which is a reader/writer for realizing an RFID function described later as well as a control device 20 (controller) performing various controls of the ink-jet printer 4 are provided in the lower unit 2. When it is detected that the upper unit 3 is opened with respect to the lower unit 2, the control device 20 controls an operation of the carriage 15 so that the carriage 15 is moved to a predetermined cartridge replacement position (a central position in FIG. 2). Since the carriage 15 in this cartridge replacement position faces the opening 8, a user is capable of replacing the cartridges 18A to 18D through the opening 8.

Figure 3:
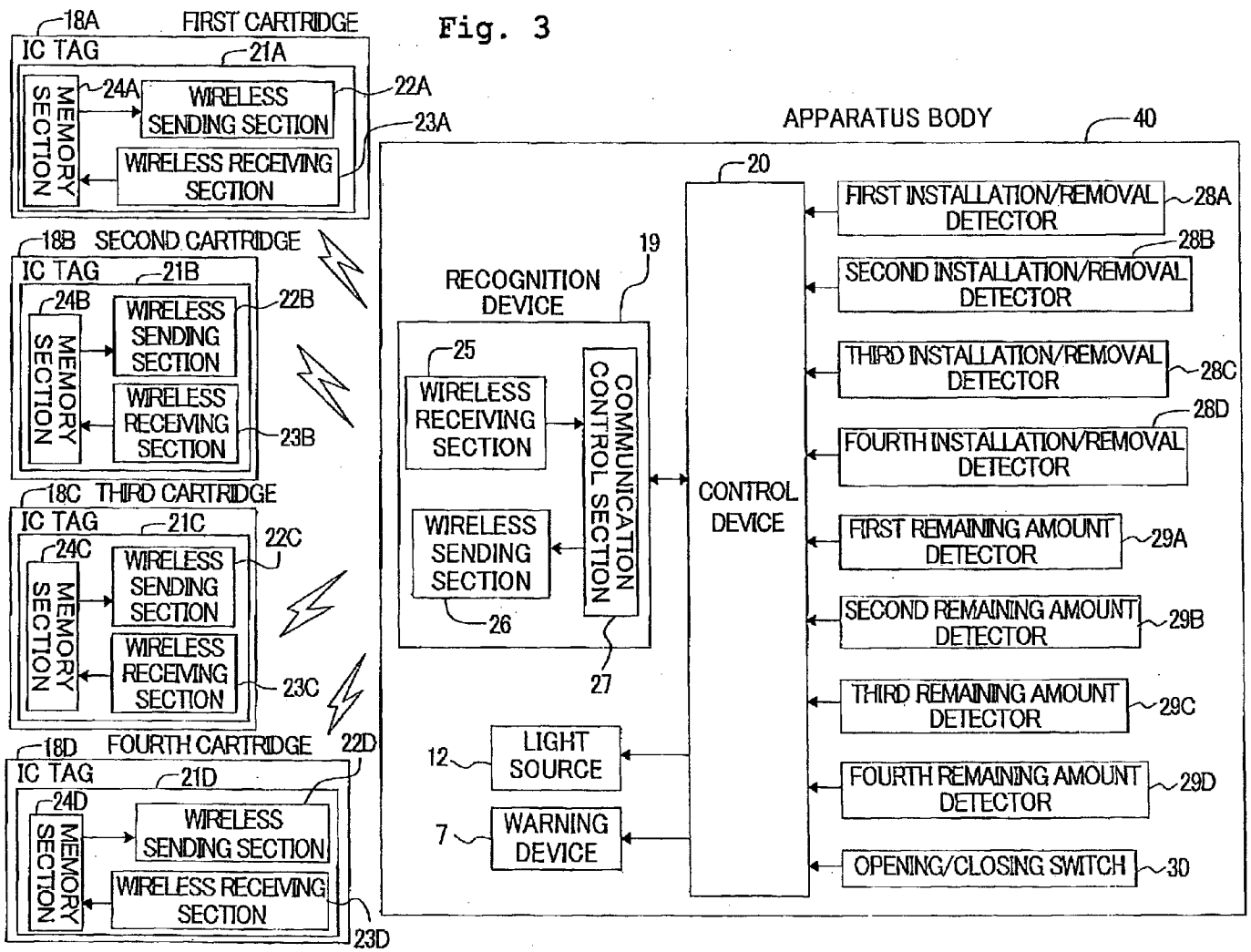
FIG. 3 is a functional block diagram of the ink-jet printer according to the first embodiment of the present invention.

As shown in FIG. 3, the ink-jot printer 4 is provided with an apparatus body 40 and the first to the fourth cartridges 18A to 18D removably installed to the cartridge installing section 17 (see FIG. 2) of the apparatus body 40. The apparatus body 40 is provided with the recognition device 19, the control device 20, the light source 12, the warning device 7, a first to a fourth installation/removal detecting sensors 28A to 28D (installation/removal detector), a first to a fourth remaining amount detecting sensors 29A to 29D (remaining amount detecting sections), and an opening/closing switch 30.

The recognition device 19 is provided with a wireless receiving section 25, a wireless sending section 26, and a communication control section 27. The recognition device 19 communicates with IC tags 21A to 21D described later by using an RFID technique, which is an example of a NFC (near field communication). The recognition device 19 is designed so that, even when a power source is turned on for the ink-jet printer 4, the recognition device 19 is turned off and does not consume electricity until the RFID function is turned on by the control device 20. The first to the fourth installation/removal detecting sensors 28A to 28D are provided for the carriage 15 (see FIG. 2) and each of the individual installation/removal detecting sensors 28A to 28D detects whether or not each of the cartridges 18A to 18D is installed to the cartridge installing section 17. The first to the fourth remaining amount detecting sensors 29A to 29D are provided for the carriage 15 (see FIG. 2) and each of the remaining amount detecting sensors 29A to 29D detects an ink remaining amount of each of the cartridges installed to the cartridge installing section 17. The opening/closing switch 30 detects whether or not the upper unit 3 is opened with respect to the lower unit 2 (the upper unit 3 is rotated upward). The control device 20 controls the recognition device 19, the light source 12, the warning device 7, etc. depending on signals from the recognition device 19, the installation/removal detecting sensors 28A to 28D, the remaining amount detecting sensors 29A to 29D, the opening/closing switch 30, etc.

The IC tags 21A to 21D (second communication sections) for realizing the RFID function described later are attached to the cartridges 18A to 18D respectively. The IC tag 21A is provided with the wireless sending section 22A, the wireless receiving section 23A, and a memory section 24A. When the IC tag 21A enters a communication area (such as within about 20 cm from the recognition device 19) which is a range in which the IC tag 21A is capable of performing the near field communication with the recognition device 19 by the RFID technique, the IC tag 21A communicates with the recognition device 19. A cartridge information, such as an ink type information of the cartridge 18A provided with the IC tag 21A, is stored in the memory section 24A of the IC tag 21A. Like the IC tag 21A, the IC tags 21B to 21D are also provided with the wireless sending sections 22B to 22D, the wireless receiving sections 23B to 23D, and the memory sections 24B to 24D, respectively.

Figure 4:
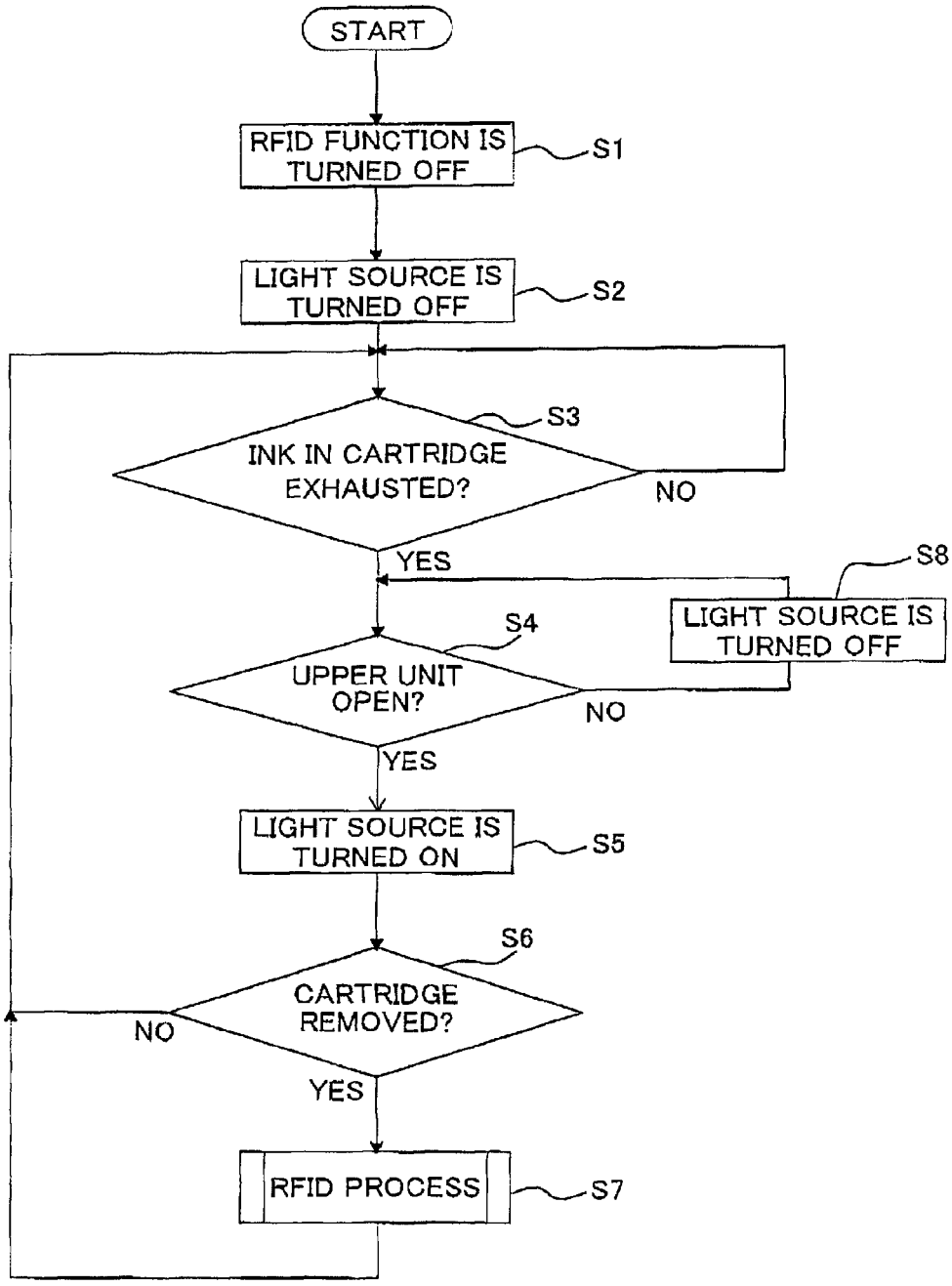
FIG. 4 is a flowchart explaining a main processing of the ink-jet printer according to the first embodiment of the present invention.

As shown in FIG. 4, when the power source is turned on for the ink-jet printer 4, the control device 20 turns the RFID function off in a state that the recognition device 19 is turned off (step S1) and leaves the light source 12 in a state of being turned off (step S2). Then, the control device 20 judges whether or not at least one of the remaining amount detecting sensors 29A to 29D detects that the ink in each of the cartridges 18A to 18D is exhausted (step S3). In a case that it is not detected that the ink is exhausted, that is, in a case that the ink not less than a predetermined amount remains in each of the cartridges 18A to 18D (step S3: No), the step S3 is repeated. On the other hand, in a case that it is detected that the ink is exhausted, that is, in a case that the ink not less than a predetermined amount does not remain in at least one of the cartridges 18A to 18D (step S3: Yes), the control device 20 judges whether or not the opening/closing switch 30 detects that the upper unit 3 is opened upward with respect to the lower unit 2 (step S4).

In a case that it is not detected that the upper unit 3 is opened (step S4: No), the light source 12 is left in the state of being turned off (step S8) and the step S4 is repeated. On the other hand, in a case that it is detected that the upper unit 3 is opened (step S4: Yes), the control device 20 turns the light source 12 on (step S5) for preparing replacement of at least one of the cartridges 18A to 18D. When the light source 12 is turned on, the light source 12 emits a light toward the opening 8, and the cartridge installing section 17 and the vicinity thereof are illuminated with the light. Thus, a job area for cartridge replacement is lighted up and can be easily seen even in a state that the upper unit 3 is slightly opened with respect to the lower unit 2. Then, the control device 20 judges whether or not the installation/removal detecting sensors 28A to 28D detect that the cartridges 18A to 18D are removed, respectively (step S6).

In a case that it is not detected that at least one of the cartridges 18A to 18D is removed (step S6: No), the operation is returned to the step S3. In this state, since the cartridges 18A to 18D are installed to the cartridge installing section and it is detected that at least one of the cartridges 18A to 18D has no ink remaining amount (step S3: Yes), the control device 20 judges whether or not the upper unit 3 is opened upward with respect to the lower unit 2 (step S4). Here, in a case that the upper unit 3 is closed by the user (step S4: No) in a state that at least one of the cartridges 18A to 18D, which is detected there is no ink remaining amount, is not replaced, the light source 12 is turned off (step S8). Then, in a case that the upper unit 3 is opened again upward with respect to the lower unit 2 by the user (step S4: Yes), the light source 12 is turned on (step S5).

On the other hand, in a case that it is detected that at least one of the cartridges 18A to 18D is removed (step S6: Yes), the control device 20 performs a RFID process (step S7).

Figure 5:
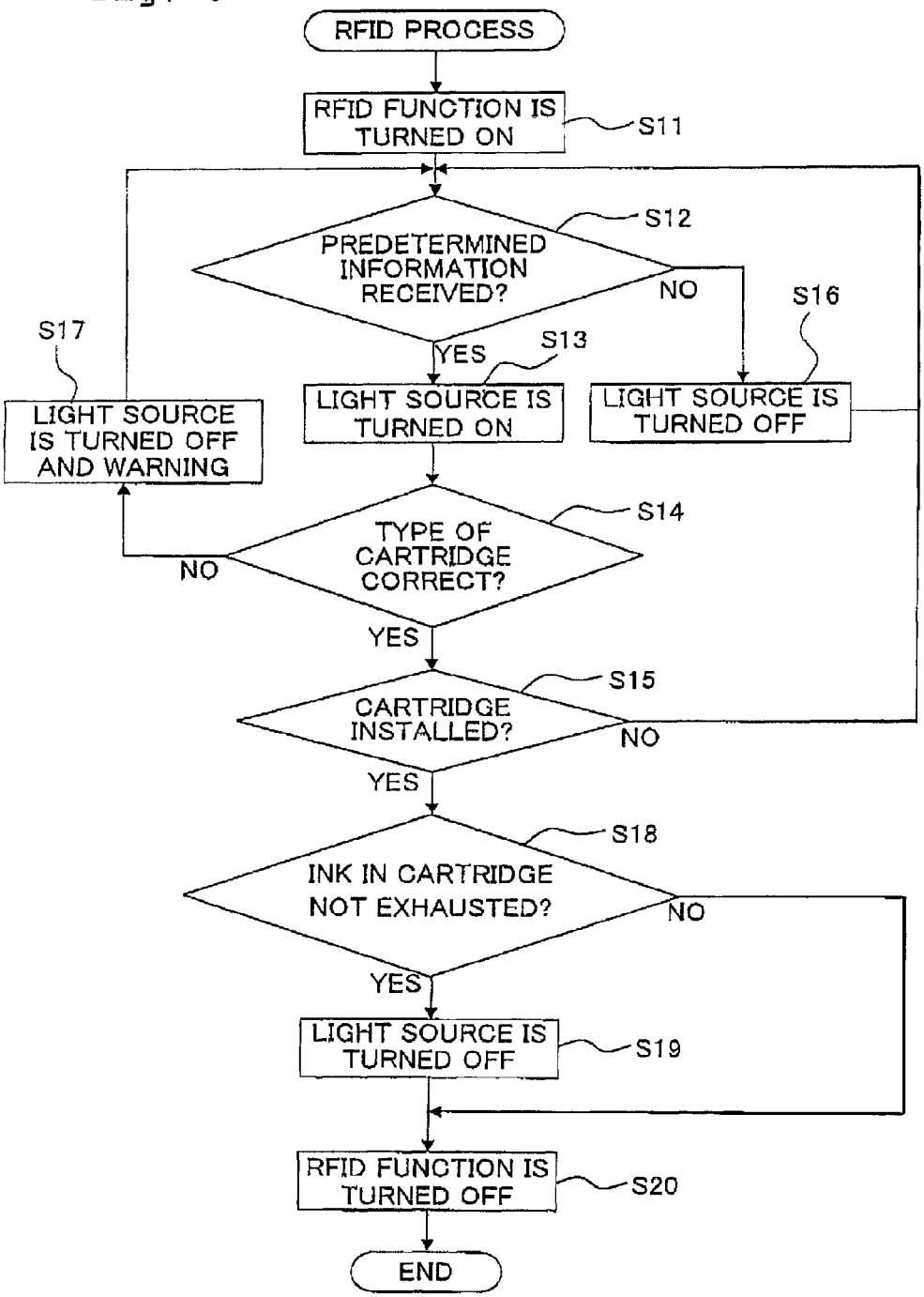
FIG. 5 is a flowchart explaining an RFID process of the ink-jet printer according to the first embodiment of the present invention.

In the following, the RFID process will be described. This process is performed, in a state that the upper unit 3 is opened. As shown in FIG. 5, the control device 20 turns on the RFID function when the RFID process is started (step S11). In particular, the control device 20 starts the recognition device 19 to send a radio wave including a control signal from the wireless sending section 26. For example, in a case that the cartridge 18A is removed from the cartridge installing section 17 and is in the communication area, the IC tag 21A of the cartridge 18A receives the radio wave from the wireless sending section 26 at the wireless receiving section 23A. Then, in the IC tag 21A, an electromotive force is generated to activate an internal circuit and the cartridge information stored in the memory section 24A is modulated and is sent through a carrier from the wireless sending section 22A. When the recognition device 19 receives the carrier from the wireless sending section 22A at the wireless receiving section 25, the recognition device 19 demodulates the cartridge information through the carrier to input it into the control device 20.

The control device 20 judges whether or not the recognition device 19 receives a predetermined information from each of the IC tags 21A to 21D (step S12). Here, the "predetermined information" includes, for example, a cartridge information corresponding to a type of an ink in the cartridge.

In a case that the predetermined information is received (step S12: Yes), the control device 20 turns the light source 12 on (step S13). That is, for example, just after the cartridge 18A, which has no ink remaining amount, is removed from the cartridge installing section 17, the cartridge 18A is still in the communication area. Thus, the light source 12 keeps a turning-on state. The control device 20 then judges whether or not a type of the cartridge 18A in the communication area is correct (step S14). In particular, in a case that the recognition device 19 receives the same number of the cartridge informations as that of the cartridges (four cartridges in this example) installed to the cartridge installing section 17 from each of the IC tags 21A to 21D, and that the cartridge informations (four cartridge informations in this example) include the ink type informations corresponding to the ink colors (four colors in this embodiment) respectively, the control device 20 judges that the type of each of the cartridges 18A to 18D is correct. In a case that the type of each of the cartridges is correct (step S14: Yes), the control device 20 judges by the installation/removal detecting sensors 28A to 28D whether or not all types of cartridges 18A to 18D are installed to the cartridge installing section 17 (step S15). In a case that all types of cartridges 18A to 18D are not installed to the cartridge installing section 17 (step S15: No), the operation is returned to the step S12 and the control device 20 judges again whether or not the predetermined information is received. That is, a loop, in which the operation is returned from the step S15 to the step S12, is repeated during cartridge replacement.

On the other hand, for example, in a case that the cartridge 18A is taken out of the communication area, it is judged that the predetermined information is not received (step S12: No), the light source 12 is turned off (step S16), and the operation is again returned to the step S12. In a case that the cartridge 18A is again introduced into the communication area and it is judged that the predetermined information is received (step S12: Yes), the light source 12 is again turned on (step S13) and the processes subsequent to the step S14, described above, are performed.

Next, a case, in which cartridges 18A to 18D each of which is new but incorrect in the ink type are introduced into the communication area, will be taken into consideration. For example, in a case that the new cartridge 18B is introduced into the communication area when the cartridge 18A is removed from the cartridge installing section, the recognition device 19 receives the cartridge information from the IC tag 21B of the cartridge 18B (step S12: Yes), and thus, the light source is turned on (step S13). However, the cartridge information received by the recognition device 19 is different from that of the cartridge 18A required to be replaced. Accordingly, it is judged that the type of the cartridge is incorrect (step 14: No), the light source 12 is turned off, and the warning device 7 is activated (step S17). Then, the processes subsequent to the step S12 are again performed. Accordingly, since the light source 12 is turned off and the warning device 7 is activated, the user is capable of knowing that the cartridge incorrect in the ink type is about to be installed to the cartridge installing section 17, and thus, it is possible to avoid an erroneous cartridge installation in advance. In this embodiment, although the activation of the warning device 7 is to turn the LED warning lamp 7 on or to flash it on and off, the warning may be made by flashing the light source 12 on and off instead of turning off it. The warning may be made by generating an alarm.

Next, a case, in which cartridges 18A to 18D each of which is correct in the ink type but not new are introduced into the communication area, will be taken into consideration. For example, in a case that the cartridge 18A which is not new is introduced into the communication area when the cartridge 18A is removed from the cartridge installing section, the recognition device 19 receives the cartridge information from the cartridge 18A (step S12: Yes), and thus, the light source 12 is turned on (step S13). Further, since the type of the cartridge required to be replaced is also correct (step S14: Yes), the control device 20 judges whether or not the installation/removal detecting sensors 28A to 28D detect that all of the cartridges 18A to 18D are installed (step S15). In a case that it is not detected that all of the cartridges 18A to 18D are installed (step S15: No), the processes subsequent to the step S12 are again performed.

In a case that it is detected that all of the cartridges 18A to 18D are installed (step S15: Yes), the control device 20 judges whether or not the remaining amount detecting sensors 29A to 29D detect that the ink in the cartridges 18A to 18D are not exhausted (step S18). For example, in a case that it is detected that the ink in the cartridge 18A is exhausted (step S18: No), the control device 20 turns the RFID function off while the light source 12 keeps the turning-on state (step S20). That is, by keeping the light source 12 turned on, it is possible to let the user know that the empty cartridge 18A is installed. Even if the empty cartridge 18A is installed, when the opening/closing switch 30 detects that the upper unit 3 is closed in the main processing (see FIG. 4) after completion of the RFID process (step S4), the light source 12 is turned off (step S8).

Next, a case, in which cartridges 18A to 18D each of which is new and correct in the ink type are introduced into the communication area, will be taken into consideration. In this case, the processes are same, up to the step S15, as the case in which cartridges 18A to 18D each of which is correct in the ink type but not new are introduced into the communication area. The light source 12 is turned on, and thus, cartridge replacement can be easily made. Then, for example, it is judged that the ink remaining amount of the cartridge 18A is not exhausted (step S18: Yes), the control device 20 turns the light source 12 off (step S19) and turns the RFID function off (step S20). That is, by turning off the light source 12, it is possible to let the user know that the cartridge 18A which is correct and not empty is installed.

According to the configuration described above, in a case that: at least one of the cartridges 18A to 18D is removed from the cartridge installing section 17; at least one of the cartridges 18A to 18D is in the communication area from the recognition device 19 of the apparatus body 40; and the recognition device 19 receives the predetermined information from at least one of the IC tags 21A to 21D in the communication area by the near field communication using the RFID technique, the light source 12 is turned on to illuminate the cartridge installing section 17 and the vicinity thereof. Accordingly, workability of cartridge replacement is improved. Further, the function of the recognition device 19 is turned off in a state that the cartridges 18A to 18D are installed in the cartridge installing section 17. Accordingly, in this state, it is possible to avoid malfunction of the light source 12 and to reduce electricity required for the recognition device 19. Furthermore, even in a state that at least one of the cartridges 18A to 18D is removed from the cartridge installing section 17, when at least one of the removed cartridges is moved away from the cartridge installing section 17 by a distance to some extent and moved to the outside of the communication area, the recognition device 19 is incapable of receiving the information from the IC tag of the at least one of the removed cartridges. Thus, the light source 12 does not emit the light and electricity required for the light source 12 can also be reduced.

Figure 6:
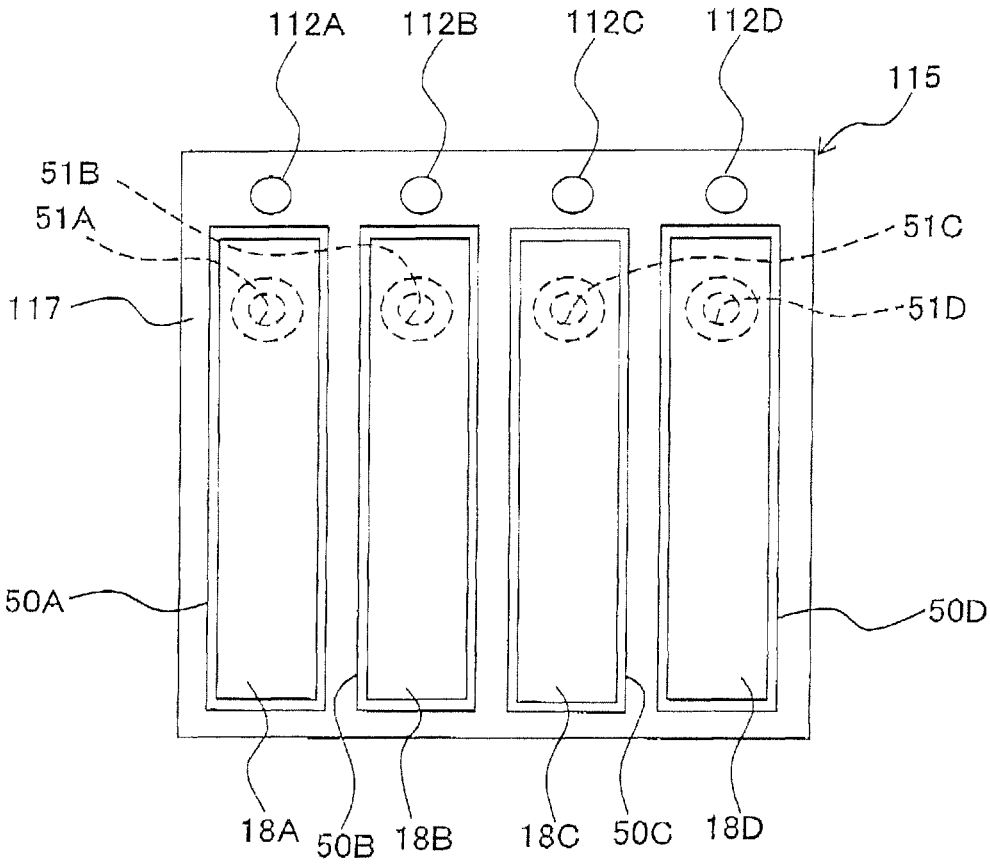
FIG. 6 is a plan view of a cartridge installing section of an ink-jet printer according to a second embodiment of the present invention.

Next, a second embodiment of the present invention will be described. As shown in FIG. 6, a cartridge installing section 117 has a plurality of slot sections 50A to 50D into which four cartridges 18A to 18D are inserted individually. Ink inflow ports 51A to 51D are provided on bottom surfaces of the slot sections 50A to 50D respectively. Light sources 112A to 112D each of which is constructed of a LED lamp and corresponds to each of the slot sections 50A to 50D are attached on an upper surface of a carriage 115, at positions each of which is adjacent to each of the slot sections 50A to 50D.

Figure 7:
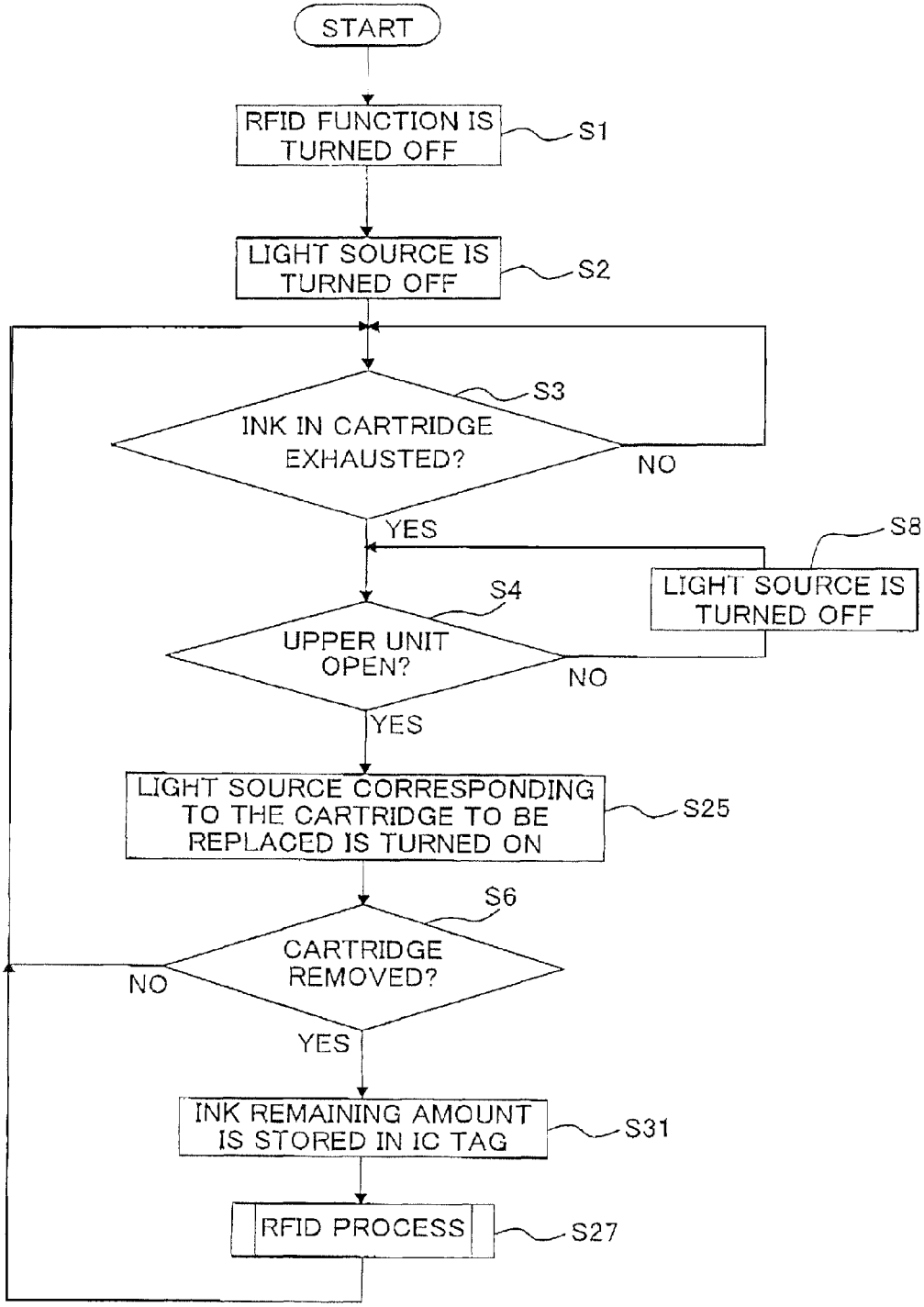
FIG. 7 is a flowchart explaining a main processing of the ink-jet printer according to the second embodiment of the present invention.

Hereinafter, a main processing of an ink jet printer of the second embodiment will be described with reference to FIG. 7. In FIG. 7, steps S1, S2, S3, S6, and S8 are substantially similar to those of the first embodiment, and thus a detailed explanation thereof is omitted here. As shown in FIG. 7, in a case that it is judged in the step S4 that the upper unit 3 is opened (step S4: Yes), the control device 20 turns on at least one of the light sources 112A to 112D corresponding to at least one of the cartridges 18A to 18D detected by the remaining amount detecting sensors 29A to 29D that the ink is exhausted (step S25). Accordingly, the cartridge installing section 117 and the vicinity thereof are illuminated by the light, the work area for cartridge replacement is lighted up, and it is possible for the user to easily distinguish at least one of the cartridges 18A to 18D as the replacement objective even when the upper unit 3 is opened. Therefore, workability in a case of replacing at least one of the empty cartridges 18A to 18D having no ink remaining amount with a new one is improved. Then, when one of the installation/removal detecting sensors 28A to 28D detects removal of one of the cartridges 18A to 18D (step S6), the control device 20 sends the latest information of the ink remaining amount of the removed cartridge to the removed cartridge by the recognition device 19, so that the information is stored in the memory section of the IC tag provided on the removed cartridge (step S31), and performs a RFID process (step S27).

Figure 8:
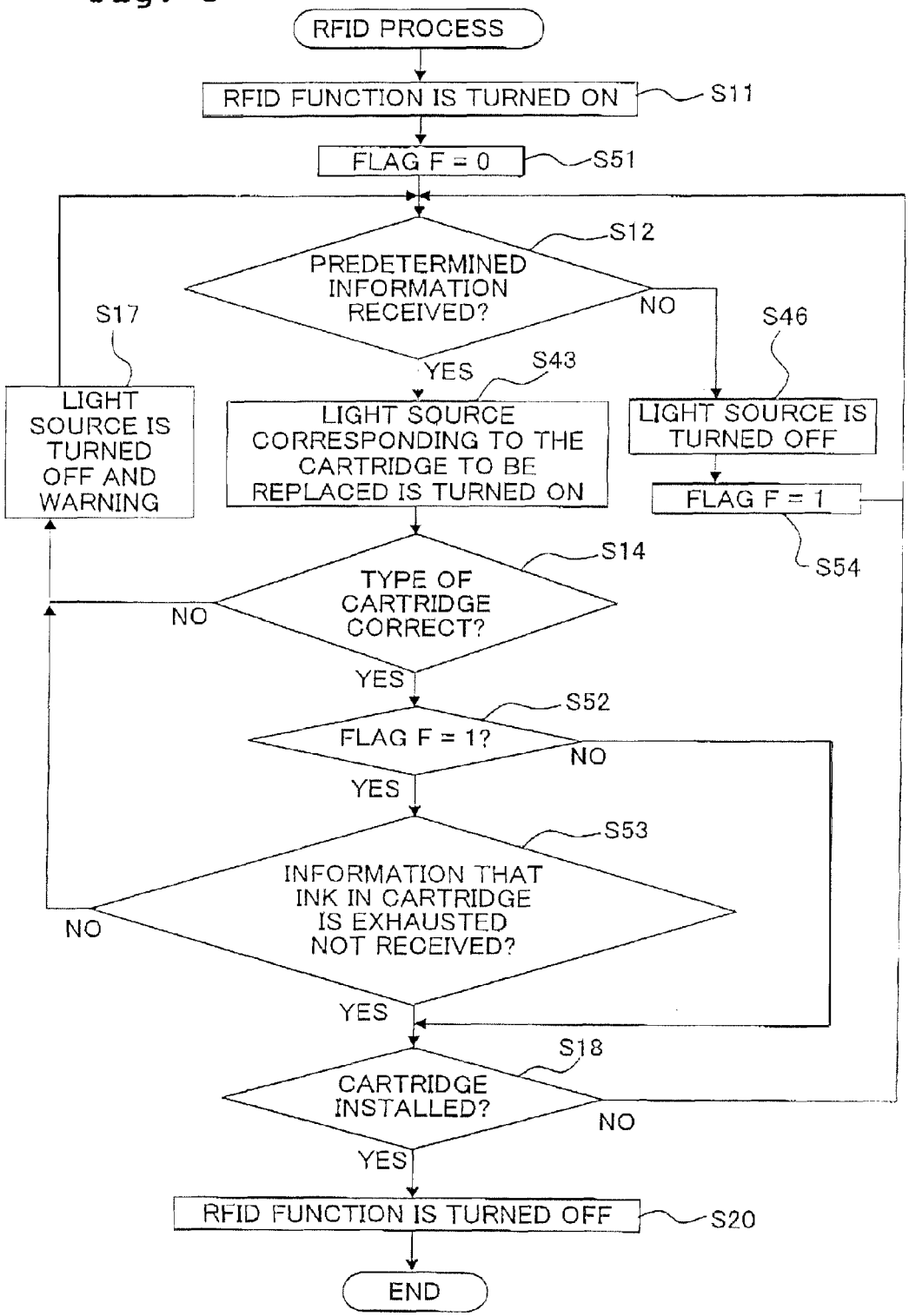
FIG. 8 is a flowchart explaining an RFID process of the ink jet printer according to the second embodiment of the present invention.

Next, the RFID process of the ink-jet printer of the second embodiment will be described with reference to FIG. 8. In FIG. 8, steps S11, S12, S14, S17, S18 and S20 are substantially similar to those of the first embodiment, and thus a detailed explanation thereof is omitted here. As shown in FIG. 8, the control device 20 turns on the RFID function when the RFID process is started (step S11), and set a flag F to "0". Then, in a case that it is judged that the recognition device 19 receives the predetermined information (step S12: Yes), the control device 20 turns on at least one of the light sources 112A to 112D corresponding to at least one of the cartridges 18A to 18D having no ink remaining amount (step S43). That is, for example, just after the empty cartridge 18A is removed from the cartridge installing section 117, the cartridge 18A is still in the communication area, and thus, the light source 112A keeps a turning-on state.

Then, in a case that it is judged that the type of the cartridge is correct (step S14: Yes), the control device 20 judges whether or not the flag F is "1" (step S52). In a case that the empty cartridge 18A has never been taken out of the communication area, the flag F remains at "0" (step S52: No). Accordingly, it is judged whether or not the cartridge 18A is installed (step S18). In the step S18, the cartridge 18A is not installed (step S18: No), and the operation is returned to the step S12. In a case that the empty cartridge 18A is taken out of the communication area, it is judged "No" in the step S12, the light source 112A which has been turned on is turned off (step S46), and the flag F is set to "1" (step S54). Then, the operation is returned to the step S12. Thus, it is judged "Yes" in the subsequent step S52, the operation advances to the step S53.

In the step S53, the control device 20 judges whether or not the cartridge information received by the recognition device 19 includes an information that the ink is exhausted. For example, in a case that the cartridge 18A which has no ink remaining amount is introduced into the communication area when the cartridge 18A is removed from the cartridge installing section, it is judged "No" in the step S53, the light source 112A is turned off, and the warning device 7 is activated (step S17). As such, due to the activation of the warning device 7, it is possible to let the user know that the empty cartridge 18A is about to be installed. In this embodiment, although the activation of the warning device 7 is to turn the LED warning lamp 7 on or to flash it on and of the warning may be made by flashing each of the light sources 112A to 112D on and off. The warning may be made by generating an alarm.

On the other hand, in a case that a new cartridge 18A is introduced into the communication area when the cartridge 18A is removed from the cartridge installing section (step S3: Yes), the light source 112A is turned on (step S43), and thus, cartridge replacement can be easily made. Since the cartridge 18A introduced into the communication area is new, it is judged "Yes" in the step S53. Then, when all of the cartridges 18A to 18D are installed (step S18: Yes), the RFID function is turned off (step S20), and the RFID process is completed.

In this embodiment, a timing, at which the information of the ink remaining amount is sent from the recognition device 19 to the IC tags 21A to 21D, is a timing, at which at least one of the installation/removal detecting sensors 28A to 28D detects removal of at least one of the cartridges 18A to 18D. Other timings, however, may be also available. For example, every time a print job of the ink-jet printer 4 is completed, each of the ink remaining amount informations, latest at the time, may be sent from the recognition device 19 to each of the IC tags 21A to 21D. Further, the memory sections 24A to 24D of the IC tags 21A to 21D may retain the number of times for which the ink of the corresponding cartridge is exhausted. Then, due to the communication between the recognition device 19 and each of the IC tags 21A to 21D, the control device 20 is capable of distinguishing the number of times for which each of the cartridges 18A to 18D is reused.

Although the ink-jet printer is exemplified as an image forming apparatus in each of the embodiments described above, a laser printer, etc. may be also available. The present invention is not limited to the embodiments described above. Changes and modifications, additions and deletions may be made to the configurations described above without departing from the scope or spirit of the invention. Each of the embodiments may be arbitrarily combined each other, for example, some configurations or methods of one embodiment may be applied to those of another embodiment.

What is claimed is:

1. An image recording apparatus, comprising:

an apparatus body;

a cartridge containing a recording material;

a cartridge installing section which is provided in the apparatus body and to which the cartridge is removably installed;

a first communication section which is provided in the apparatus body;

a second communication section which is provided in the cartridge and which communicates with the first communication section by using a near field communication;

a light source which is provided in the apparatus body and emits light to illuminate the cartridge installing section;

an installation/removal detector which is provided in the apparatus body and detects whether or not the cartridge is installed to the cartridge installing section; and a controller which controls the light source and the first communication section;

wherein the controller controls the light source to emit the light in a case that the first communication section receives a predetermined information from the second communication section;

wherein the controller turns the first communication section on in a case that the installation/removal detector detects a removal of the cartridge from the cartridge installing section;

wherein the controller turns the light source off, in a case that the cartridge removed from the cartridge installing section is moved outside a communication area in which the second communication section communicates with the first communication section by using the near field communication, and that the first communication section does not receive the predetermined information from the second communication section; and wherein the controller turns the first communication section off in a case that the installation/removal detector detects an installation of the cartridge to the cartridge installing section.

2. The image recording apparatus according to claim 1;

wherein the cartridge includes a plurality of individual cartridges;

wherein the cartridge installing section has a plurality of slot sections into which the plurality of individual cartridges are inserted;

wherein the installation/removal detector is configured to detect an installation/removal of at least one of the plurality of individual cartridges correspond to at least one of the slot sections; and wherein the predetermined information includes a cartridge information of the cartridge to be installed to the slot section which is detected by the installation/removal detector that the cartridge is removed.

3. The image recording apparatus according to claim 1;

wherein the apparatus body has a remaining amount detecting section which detects a remaining amount of the recording material in the cartridge installed to the cartridge installing section; and wherein the controller controls the light source to emit the light in a case that the installation/removal detector detects the installation of a new cartridge after the removal of the cartridge from the cartridge installing section and that the remaining amount detecting section detects that the remaining amount of the recording material in the new cartridge is less than a predetermined value.

4. The image recording apparatus according to claim 1;

wherein the second communication section has a memory section which stores an information of a remaining amount of the recording material in the cartridge provided with the memory section; and wherein the predetermined information includes an information that the remaining amount of the recording material in the cartridge provided with the second communication section is more than a predetermined value.

5. The image recording apparatus according to claim 4;

wherein the apparatus body has a remaining amount detecting section which detects a remaining amount of the recording material in the cartridge installed to the cartridge installing section; and wherein the controller controls the first communication section to send the information of the remaining amount of the recording material detected by the remaining amount detecting section to the second communication section at a predetermined timing by wireless, so that the information of the remaining amount of the recording material is stored in the memory of the second communication section.

6. The image recording apparatus according to claim 5;

wherein the predetermined timing includes a timing at which the installation/removal detector detects the removal of the cartridge.

7. The image recording apparatus according to claim 1, further comprising:

a warning mechanism which warns a user of an abnormal operation of the apparatus, wherein the controller further controls the warning mechanism to warn the user in a case that the information which is sent from the second communication section and received by the first communication section is not the predetermined information.

8. The image recording apparatus according to claim 1, further comprising:

a lower unit in which the cartridge installing section is provided; and an upper unit in which a scanner is provided, and which is connected to the lower unit by a hinge so that the upper unit is openable and closable with respect to the lower unit;

wherein an upper surface of the lower unit has an opening which faces the cartridge installing section provided in the lower unit;

wherein the light source is provided on a bottom surface of the upper unit so that the light source emits light to illuminate the opening;

wherein the controller turns the light source on in a case that the upper unit is opened with respect to the lower unit; and wherein, in a case that the cartridge removed from the cartridge installing section is moved outside the communication area and that the first communication section does not receive the predetermined information from the second communication section, the controller turns the light source off even if the upper unit is opened with respect to the lower unit.

* * * * *